United States Patent [19]

Eaton

[11] Patent Number: 4,740,991

[45] Date of Patent: Apr. 26, 1988

[54] CRUCIBLE

[75] Inventor: Edgar P. Eaton, Convent Station, N.J.

[73] Assignee: Carbone, USA Corp., Boontown, N.J.

[21] Appl. No.: 34,735

[22] Filed: Apr. 6, 1987

[51] Int. Cl.[4] ..... H05B 3/00
[52] U.S. Cl. ..... 373/118
[58] Field of Search ..... 373/118; 422/78

[56] References Cited

U.S. PATENT DOCUMENTS 4,403,955 9/1983 Sarno ..... 373/118

FOREIGN PATENT DOCUMENTS 3025210 1/1982 German Democratic Rep. ..... 373/118

*Primary Examiner*—Roy N. Envall, Jr.
*Attorney, Agent, or Firm*—Thomas R. Morrison

[57] ABSTRACT

A crucible of a resistive material has a smoothly rounded inner bottom and a radially outer portion of the outer bottom having a rounded shape. The shape of the outer bottom bears a predetermined relationship to the shape of the inner bottom. In one embodiment of the invention, the outer bottom and inner bottom have a common radius of curvature, whereby the thickness of material between the outer and inner bottom is constant. In a second embodiment of the invention, the centers of curvature differ, whereby the resistivity of material at differing radii is tailored.

7 Claims, 5 Drawing Sheets

CRUCIBLE

BACKGROUND OF THE INVENTION

The present invention relates to crucibles for fusion of a specimen and, more particularly, to crucibles made of a resistive material.

Certain types of resistance furnaces employ a graphite specimen-holding crucible for containing a sample of a material to be heated. The crucible is positioned between power-conducting electrodes for heating the crucible to a temperature sufficient to raise the specimen within to fusion temperature.

One type of crucible in the prior art is disclosed in U.S. Pat. No. 3,636,229 wherein a button centered in the bottom of the crucible aids in positioning the crucible in the bottom electrode and in localizing a substantial part of the resistive heating in the bottom region of the crucible.

U.S. Pat. No. 3,899,627 discloses a technique for increasing the direct heating of the bottom of a studded crucible without relying as much on conduction through the stud. In this technique, a curved inner surface is provided on the inside of the crucible and a chamfer is provided about the perimeter of the bottom to reduce the cross-sectional area of the bottom through which the electric current must pass.

OBJECTS AND SUMMARY OF THE INVENTION

It is an object of the invention to provide a crucible which overcomes the drawbacks of the prior art.

It is a further object of the invention to provide a crucible for heating a specimen which avoids hot spots in the bottom thereof.

It is a still further object of the invention to provide a crucible for heating a specimen which maintains a substantially uniform resistivity at all radii over a substantial portion of a bottom thereof, whereby uniform heating of a specimen therein is attained.

It is still further object of the invention to provide a crucible for heating a specimen wherein a curvature of a portion of the exterior of the bottom generally mimics a curvature of the adjacent interior of the bottom, whereby hot spots are avoided and more uniform heating is attained.

Briefly stated, the present invention provides a crucible of a resistive material having a smoothly rounded inner bottom and a radially outer portion of the outer bottom having a rounded shape. The shape of the outer bottom bears a predetermined relationship to the shape of the inner bottom. In one embodiment of the invention, the outer bottom and inner bottom have a common radius of curvature, whereby the thickness of material between the outer and inner bottoms is constant. In a second embodiment of the invention, the centers of curvature differ, whereby the resistivity of material at differing radii is tailored.

According to an embodiment of the invention, there is provided a crucible of a resistive material comprising: an annular side wall having an open top end and a closed bottom, the bottom including a concavely rounded inner surface with a first curvature, the bottom including an outer surface, at least a radially outer portion of the outer surface joining the annular side wall being convexly rounded with a second curvature, and the first and second curvatures having a functional relationship to each other.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
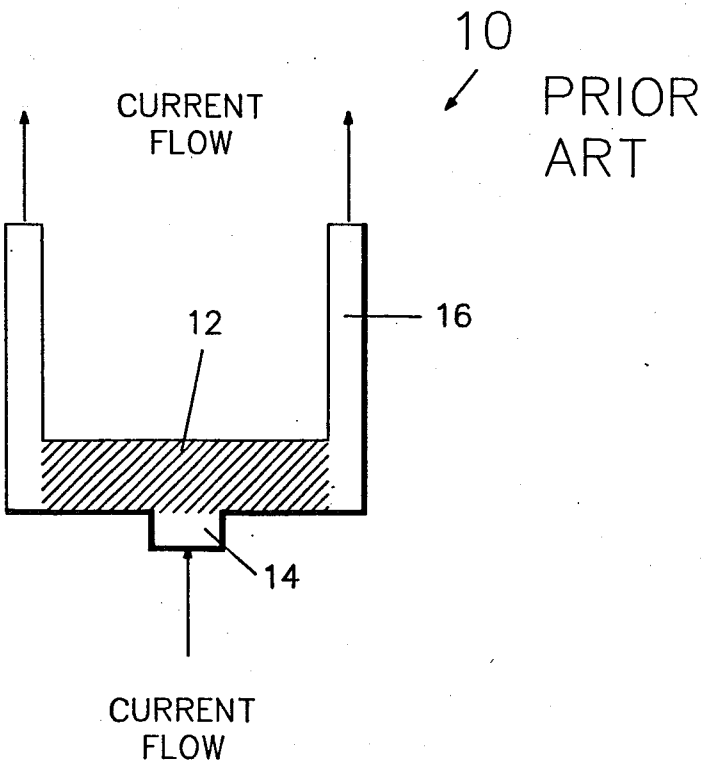
FIG. 1 is a cross section of a crucible according to a first embodiment of the prior art.

Referring first to FIG. 1, there is shown, generally at 10, a crucible according to the referenced '229 patent, the disclosure of which is herein incorporated by reference. Crucible 10 is disclosed as being made of a conductive material such as, for example, graphite. A bottom 12 includes a button 14 centrally disposed thereon. The perimeter of bottom 12 joins an annular side wall 16. In use, current is applied between the bottom of button 14 and the upper end of annular side wall 16, whereby resistive heating of crucible 10 is attained. As recited in the patent, the most intense heating takes place in the hatched region.

Figure 2:
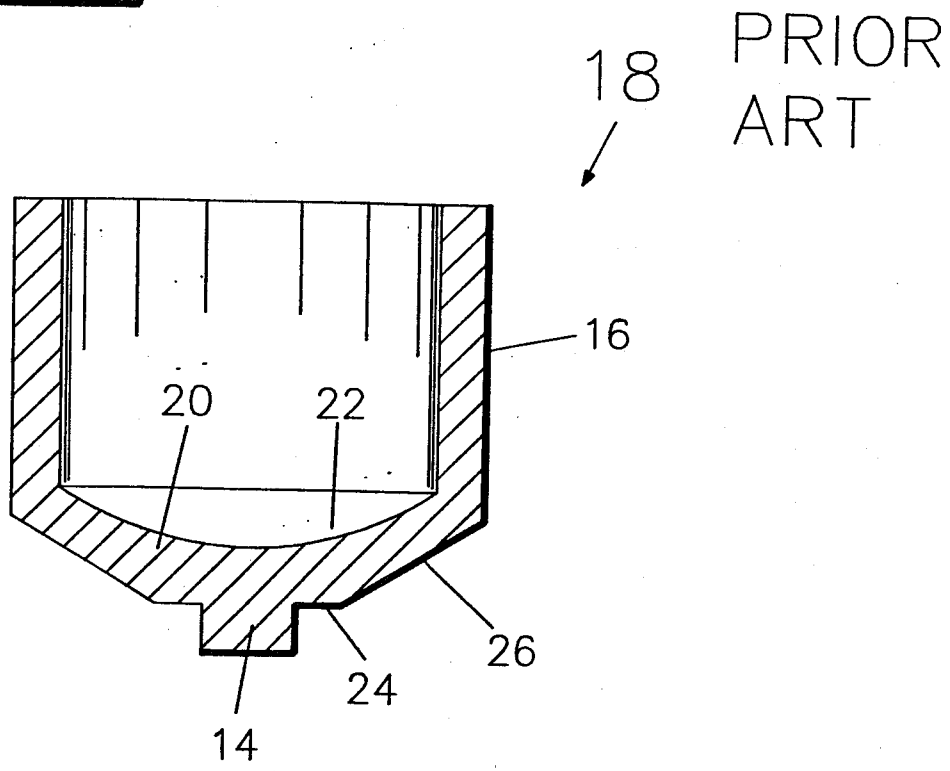
FIG. 2 is a cross section of a crucible according to a second embodiment of the prior art.

Referring now to FIG. 2, there is shown, generally at 18, a crucible corresponding to the disclosure of the '627 patent, the disclosure of which is herein incorporated by reference. A bottom 20 of crucible 18 includes a concavely rounded shape 22. An exterior of bottom 20 includes a button 14, a horizontally extending surface 24 contiguous to button 14, and a chamfer 26 between an extremity of horizontally extending surface 24 and annular side wall 16. Electrical contact at the bottom of crucible 18 is made primarily with horizontally extending surface 24, whereby electrical heating is concentrated in the resistive material between chamfer 26 and concavely rounded shape 22.

Figure 3:
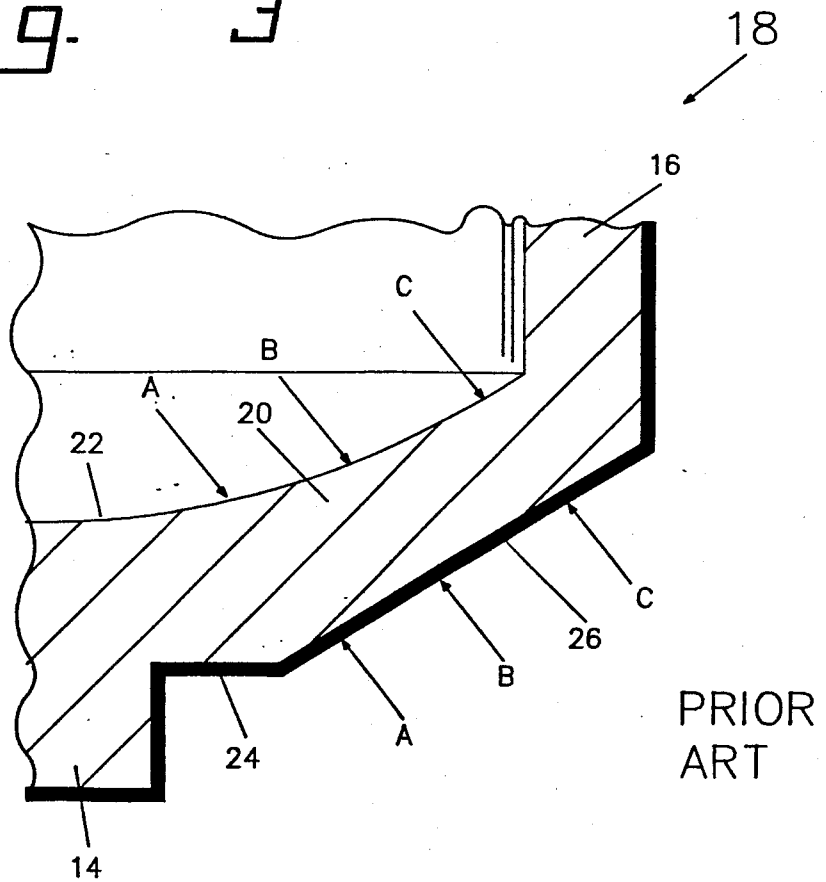
FIG. 3 is a close-up cross section of a portion of the crucible of FIG. 2 to which reference will be made in describing the production of hot spots.

Referring now to FIG. 3, it is seen that the active region in bottom 20 has a cross section defined by a curve and a straight line; that is, between concavely rounded shape 22 and chamfer 26. As a necessary consequence of this geometry, the cross section at increasing radii about an axis of crucible 18 changes in a manner which fails to take advantage of the benefits which the present invention attains. As disclosed in the referenced patent, the cross-sectional thickness of bottom 20, taken normal to chamfer 26 changes from large between arrows A-A, to smaller between arrows B-B, to larger again between arrows C-C.

Since the radius of bottom 20 between arrows A-A is smaller than it is between arrows B-B, an annular increment of resistive material in the direction of current flow in the vicinity of arrows A-A contains less resistive material than an annular increment of the same dimension in the direction of current flow in the vicinity of arrows B-B. Thus, the current density, or the amount of heating experienced for a given thickness between arrows A-A, is greater than for an equal thickness between arrows B-B. The reduced thickness between arrows B-B may overcompensate for the difference caused by the changing radius and may thus cause an annular hot spot.

The thickness in the vicinity of arrows C-C is greater than that in the vicinity of arrows B-B. Thus, increasing radius and increased thickness in the vicinity of arrows C-C combine to reduce the heating effect of the current in this region as compared to the other two regions.

Figure 4:
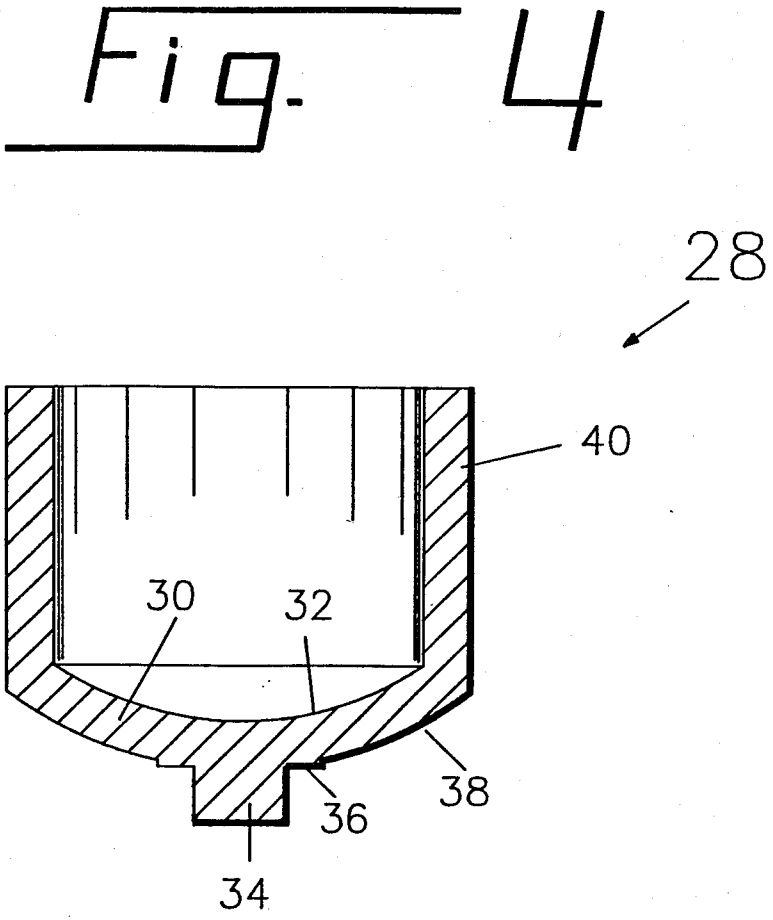
FIG. 4 is cross section of a crucible according to a first embodiment of the invention.

Referring now to FIG. 4, there is shown, generally at 28, a crucible according to an embodiment of the invention. A bottom 30 includes a concavely rounded inner shape 32, a button 34 centered in its outer surface and a horizontally extending surface 36 surrounding button 34. A radially outer portion 38 of bottom 30 is disposed between the radially outer perimeter of horizontally extending surface 36 and a bottom of an annular side wall 40. Radially outer portion 38 is curved in a manner having a predetermined relationship to the curvature of concavely rounded inner shape 32. In crucible 28, the curvature of radially outer portion 38 is concentric with the curvature of concavely rounded inner shape 32, whereby a constant thickness of material is produced therebetween. As will be clear to one skilled in the art, with a constant thickness, the resistivity of resistive material in radially outer portion 38 increases with increasing radius. Thus, the heat generated varies as function of the inverse of the radius. It is thus possible to tailor the heat generated locally within bottom 30.

Figure 5:
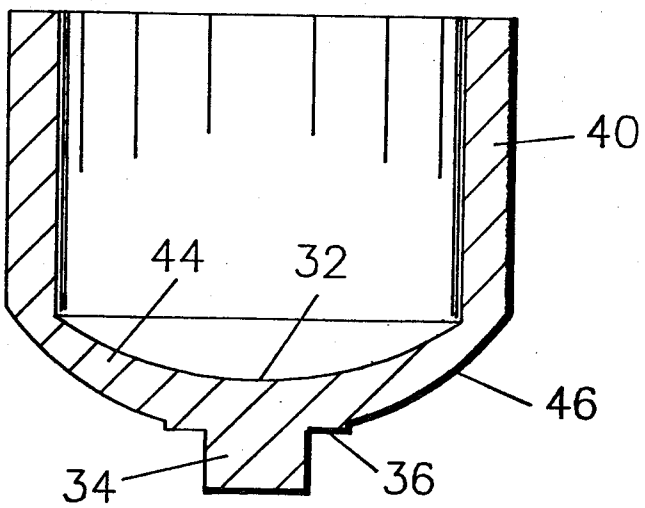
FIG. 5 is a cross section of a crucible according to a second embodiment of the invention.

In addition to the simple constant-thickness radially outer portion 38 produced by the concentric curves of FIG. 4, other functional relationships can be produced with embodiments of the present invention. Referring to FIG. 5, for example, a crucible 42 is shown having a bottom 44 with a concavely rounded inner shape 32 corresponding to the like-numbered element in FIG. 4. A button 34 is centered in the outside of bottom 44 and a horizontally extending surface 36 surrounds button 34. A radially outer portion 46, between horizontally extending surface 36 and an annular side wall 40, is curved using a radius shorter than that employed in the foregoing embodiment of the invention, whereby a continuous reduction in thickness is seen at increasing radii. In one embodiment of the invention, the reduction in thickness is selected to exactly counteract the increased resistivity of the resistive material at increasing radii, whereby uniform heating at all radii along radially outer portion 46 is attained.

Other embodiments of the invention should be seen to include a reduction in thickness exceeding that required to maintain uniform heating with increasing radii. In such an embodiment of the invention, heating is greater near annular side wall 40 than near horizontally extending surface 36.

The foregoing has tacitly assumed that the shapes of concavely rounded inner shapes 32 and radially outer portions 38 and 46 are parts of spheres. Such a limitation is not contemplated. Any smooth curve may be employed for one or both of these shapes provided that the desired functional relationship between the thickness and radius is attained. For example, it is fully within the contemplation of the invention that the shape of concavely rounded inner shapes 32 and/or radially outer portions 38 and 46 be parts of parabolic or hyperbolic figures of rotation.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What I claim is:

1. A crucible of a resistive material comprising:

an annular side wall having an open top end and a closed bottom;

said bottom including a concavely rounded inner surface with a first curvature;

said bottom including an outer surface;

at least a radially outer portion of said outer surface joining said annular side wall being convexly rounded with a second curvature;

said first and second curvatures having a functional relationship to each other; and said funtional relationship includes centers of curvature of said first and second curvatures being displaced from each other, whereby a thickness of said bottom between said inner and outer bottoms varies smoothly.

2. A crucible according to claim 1 wherein said thickness becomes smaller at increasing radii.

3. A crucible according to claim 2 wherein said thickness decreases in a functional relationship effective to maintain a resistivity of said resistive material constant at all radii.

4. A crucible according to claim 1 wherein said first and second curvatures are figures of rotation of parts of circles.

5. A crucible according to claim 1 wherein said outer bottom includes a button centered therein.

6. A crucible according to claim 1 wherein said outer bottom includes a horizontally extending surface centered in said outer surface.

7. A crucible according to claim 6 wherein said outer bottom includes a button centered in said horizontally extending surface.

* * * * *